United States Patent [19]

Wiholm

[11] 4,367,116

[45] Jan. 4, 1983

[54] BINDING APPARATUS

[75] Inventor: Sture H. Wiholm, Johanneshov, Sweden

[73] Assignee: Semotex AB, Stockholm, Sweden

[21] Appl. No.: 251,073

[22] Filed: Apr. 6, 1981

[30] Foreign Application Priority Data

Apr. 15, 1980 [SE] Sweden ..... 8002830

[51] Int. Cl.[3] ..... B42C 19/00

[52] U.S. Cl. ..... 156/366; 156/378; 156/908; 219/492; 219/502; 219/506; 219/518; 412/8; 219/243;492;502;506;518

[58] Field of Search ..... 156/477 B, 216, 475, 156/366, 359, 378; 11/1 AD; 281/21 R

[56] References Cited

U.S. PATENT DOCUMENTS 2,644,151 6/1953 Krueger ..... 156/366 X
3,330,203 7/1967 Korr ..... 219/518 X
4,141,100 2/1979 Domroe et al. ..... 11/1 AD
4,220,845 9/1980 Morveale ..... 219/243

FOREIGN PATENT DOCUMENTS 2351210 4/1975 Fed. Rep. of Germany .

*Primary Examiner*—David A. Simmons
*Attorney, Agent, or Firm*—Klarquist, Sparkman, Campbell, Leigh, Whinston & Dellett

[57] ABSTRACT

A binding apparatus, for attaching loose sheets to a folder or file provided with a binding agent, comprises a hotplate (2) against which the folder is inserted through an opening (4) defined between supporting means (5, 6). The hotplate is kept constantly heated, while a time circuit controlled by means of a push button unit (10) activates an alarm means (12) when a set time is at an end. The regulatable time circuit is always zeroed when the folder is taken out of the opening, since the folder affects a light beam across this opening to a photocell which is connected to the time circuit (FIG. 1).

9 Claims, 4 Drawing Figures

BINDING APPARATUS

Figure 1:
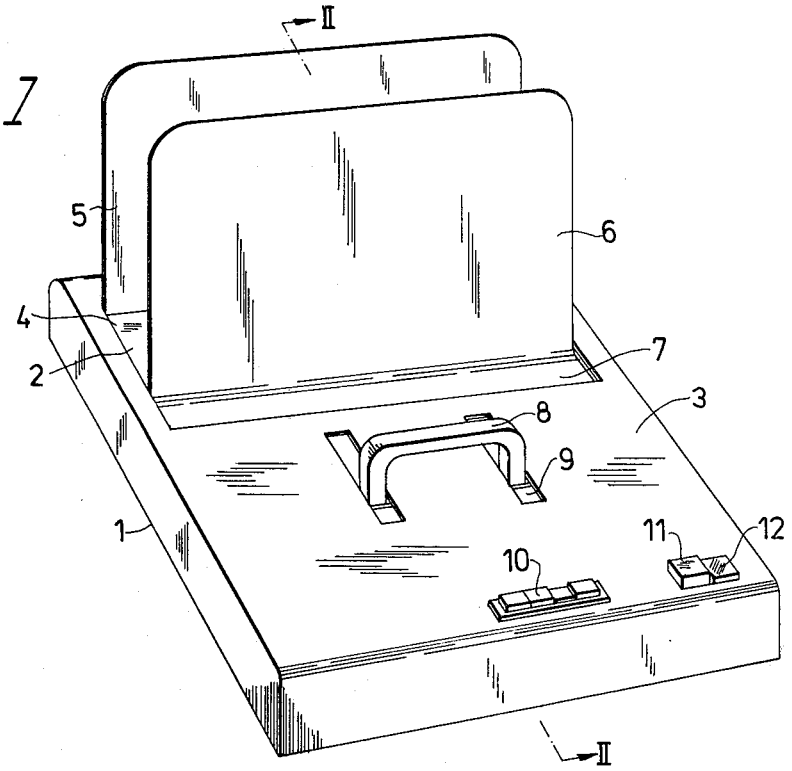

The present invention relates to an apparatus intended for binding sheets in a binder or folder provided with a binding agent. The apparatus includes a hotplate on which the folder, with sheets inserted, is placed for heating up the binding agent, this hotplate having at least one electrical heating element and being disposed in a cover provided with an opening for inserting the folder, the width of the opening being adjustable with the aid of support means, and the heating element being supplied with power via a regulating circuit including a time control means.

Such apparatus for binding loose sheets in a folder or the like is already known as shown in U.S. Pat. No. 4,141,100 of W. E. Domroe et al issued Feb. 27, 1979, and the apparatus is provided with a heating element which is supplied with power only during the time when a folder is inserted for contact with the hotplate. The heating element thus starts from cold each time fixing sheets in a folder is to be carried out. This signifies that a relatively long time is taken up for the folder provided with binding agent to be activated and take up the inserted sheets, since it is necessary to allow for the heating time required by the hotplate itself. This also causes uncertainty in judging the length of time which is to be set for obtaining proper binding, since the hotplate can be quite cold or have some residual temperature after previously performed binding operations, which must be taken into account so that the binding agent on the folder is not subjected to excessively long heating, which could lead to deteriorated binding capacity.

Known apparatus of this kind thus has a regulating circuit which is actuated by pressing the folder against the hotplate, and which closes the power circuit of the heating element for the insertion of the folder. The heating element is provided with current during a time determined with the aid of a time switch. After setting, the switch is triggered by the regulating circuit and returns to its zero position where it breaks the current supply to the heating element and signals that the set binding time has come to an end. The regulating circuit is activated by a switch disposed for coaction with the hotplate, this switch being activated by an inserted folder. When the regulating circuit has once been activated, heating up the heating element cannot be stopped before the time set on the time switch has run out. Another disadvantage with known apparatus is that the heating element is subjected to serious stresses, since it is completely switched off after each binding operation and must thus withstand large and frequent temperature variations.

The disadvantages of the known apparatus are avoided by the present invention, which relates to an apparatus where the heating element is continuously supplied with power to be heated to working temperature, and where the time control means incorporated in the regulating circuit is electrically connected to a photocell located in the vicinity of the opening such that it is illuminated by a light source which is interrupted by the insertion of a folder, thus causing the photocell to give a signal to the time control means for starting its set timing cycle, at the termination of which it activates an alarm means incorporated in the regulating circuit.

There is thus achieved a simple determinable time for each binding operation, since the hotplate maintains a given temperature. The thermic stresses in the heating element are furthermore reduced since it does not need to be subjected to continuously repeated temperature fluctuations.

By the special mounting, provided in accordance with the invention, of the heating element in the hotplate, the thermic stresses in this unit are further reduced. The intimate contact that the heating element in the form of a heating foil thus makes with the supporting surface of the hotplate results in that any temperature differences and mechanical stresses associated therewith do not occur between these parts. Good heat transfer from the heating foil to the supporting surface of the hotplate is hereby maintained.

A further advantage of the apparatus in accordance with the invention is that the time control means constitutes a push button unit with four fixed set times. The unit as well as the main switch and the alarm means, in the form of a signal lamp controlled by the regulating circuit, are arranged above the fixed table surface formed by the apparatus cover. The unit simultaneously forms connection means for receiving the printed circuit board which carries the regulating circuit components.

Figure 2:
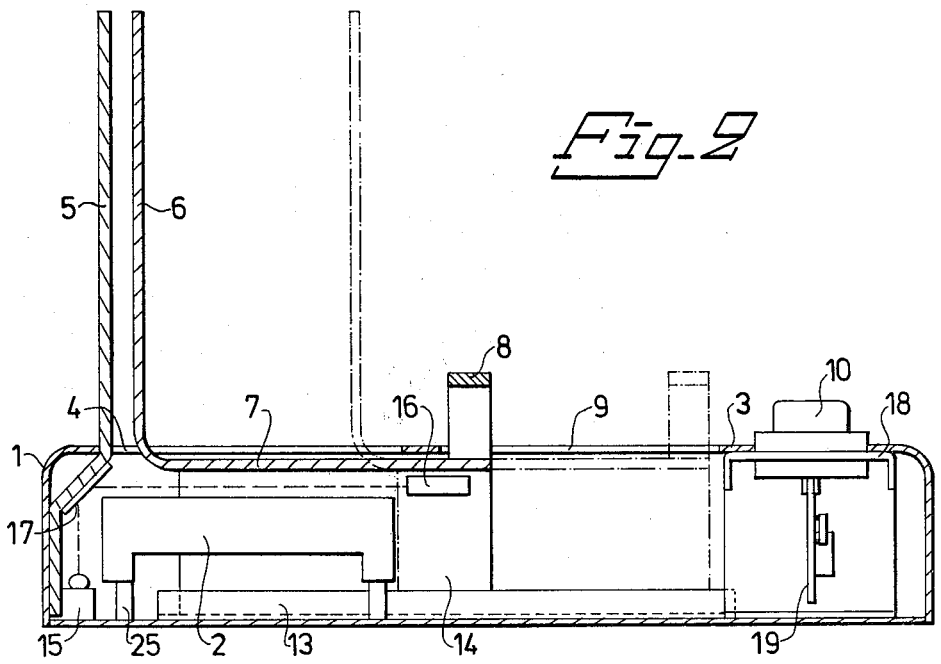
Figure 3:
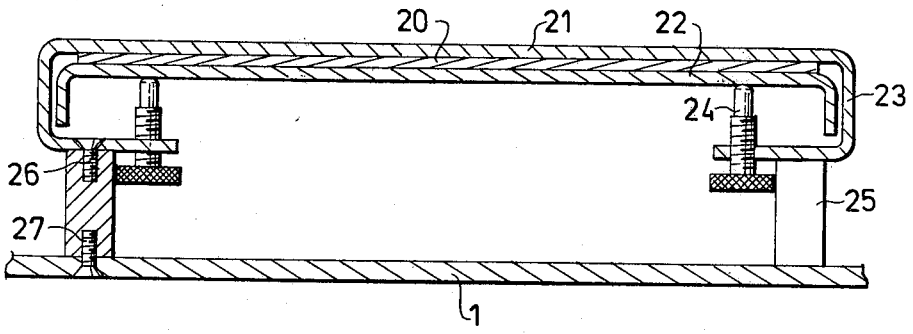
Figure 4:
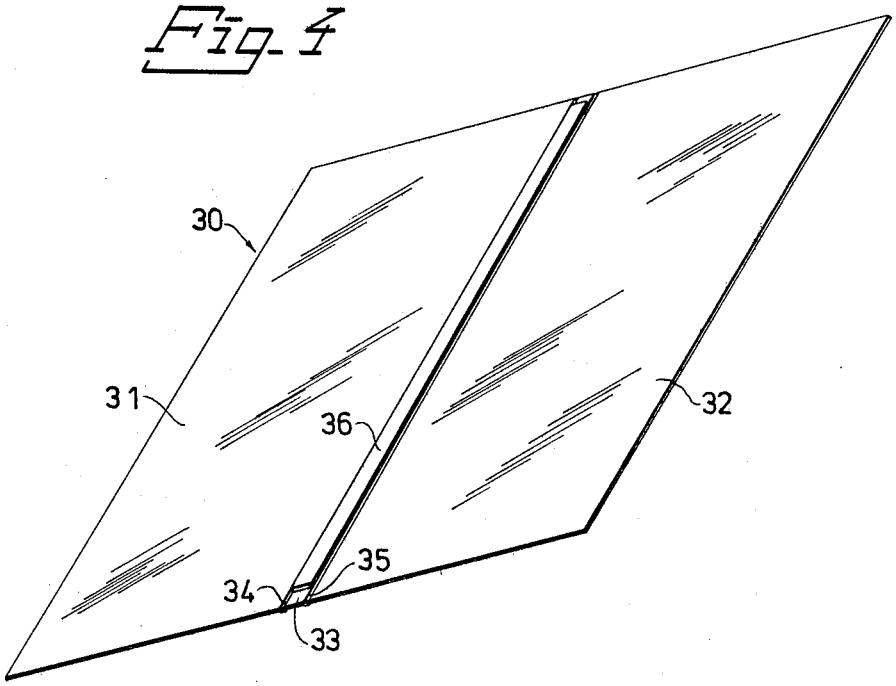

The present invention will now be described in detail below in conjunction with a preferred embodiment, which is illustrated on the accompanying drawings, where FIG. 1 is a perspective view of a binding apparatus in accordance with the invention, FIG. 2 is a section along the line II—II in FIG. 1, FIG. 3 is a cross-section of the hotplate included in the binding apparatus, and FIG. 4 illustrates a folder of the kind in which sheets can be adhered using the binding apparatus in accordance with the invention.

As will be seen from FIG. 1, the inventive binding apparatus has a housing including cover 1 surrounding a hotplate 2. The cover 1 has a table surface 3, in the back portion of which an opening 4 is made to enable one or more folders to be inserted and come into contact with the hotplate 2. At its back edge, the opening 4 is defined by a fixed rear support means 5 and at its front opposing edge by a displaceable front support means 6. The displaceable support means 6 is bent so as to have a portion 7 which is in the immediate vicinity of the underside of the table surface 3. The part 7 of the support means 6 has a handle 8 which projects up above the table surface 3 through slots 9 made therein. In the table surface 3 there are also openings for a push button unit 10, a main switch 11 and a signal lamp 12.

FIG. 2 is a section along the line II—II in FIG. 1, wherein the displaceable front support means 6 is illustrated in two different positions, the chain dotted position being that which gives the greatest opening 4, and thereby room for the thickest folder or file which can be bound, or for the greatest number of thinner folders which can be bound at one time. A pair of rails 13 are attached to the bottom of the cover 1 for carrying the displaceable support means 6. At its bent portion 7 the latter has two parallel flanges 14 intended for gliding in the rails 13, for which purpose the edges of the flanges 14 are covered with easily sliding material, e.g. Teflon tape.

The cover bottom also carries the hotplate 2, which will be more closely described in conjunction with FIG. 3 below.

A light source 15 is further arranged on the bottom of the cover to illuminate a photocell 16 via a reflector 17. The reflector 17 can be made as a blank surface on the fixed support means 5, which is then bent to a suitable angle and attached to the rear end wall of the cover 1. The photocell 16 is suitably a phototransistor connected to the regulating circuit and attached at the side of the opening 4 facing the fixed support means 5. The electrical wiring is not shown so as not to confuse the clear depiction of the mechanical structure of the apparatus.

As will be seen from FIG. 2, the push button unit 10 is let into an opening in the table surface 3 and attached to a support means 18 mounted on the bottom of the cover 1. It will be seen further how the unit 10 is formed as a connector means for the printed circuit board 19 carrying the regulating circuit and its components.

FIG. 3 illustrates in more detail the construction of the hotplate 2 and its mounting. The hotplate thus comprises a heating foil 20 providing an electrical resistance strip heater inserted between two surfaces 21, 22 of heat conductive material, e.g. aluminium. The upper surface 21 constitutes the support surface of the hotplate 2, against which the folder which is to be bound will engage. The lower surface 22 forms a pressure pad intended to urge the heating folio 20 into intimate contact with the underside of the support surface 21. This is achieved by the support surface 21 being formed with flanges 23 in which there are threaded holes for screws 24. The ends of the screws 24 act on the pad 22, either directly on its underside or on flanges which are formed on the pad 22 in correspondance to the flanges 23 of the support surface.

The hotplate 2 is mounted on the bottom of the cover 1 with the aid of bushings 25 which are attached to the flanges 23 of the support surface 21 and the bottom of the cover 1. The attachment is preferably made using blind screws 26, 27.

The function of the binding apparatus ensures that it maintains a condition of readiness, i.e. at the beginning of the workday the apparatus is started by operating the main switch 11. The hotplate 2 is thus supplied with current and the light source 15 put into operation. As a result of the advantageous embodiment of the hotplate in accordance with the invention, it is rapidly heated up, the time for this being about 50 seconds.

When one or more folders are to be bound, the apparatus is thus ready for operation. The folders 30 can be formed as will be seen from FIG. 4. Each folder 30 thus comprises cover boards 31, 32 with a spine 33 therebetween. The spine 33 is separated from the cover boards 31, 32 by crease lines 34, 35 and carries a glue strip 36 constituting a heat sensitive binding agent. Each folder 30 is provided with the sheets which are to be bound. The folder 30 with sheets in position and folded to enclose said sheets along the crease lines 34, 35 is inserted with its spine 33 first in the opening 4 of the binding apparatus and into engagement against the support surface 21 of the hotplate 2. If the folder 30 is thin, several folders can be simultaneously inserted in the opening 4. On insertion, the movable support means 6 is pulled back with the aid of the handle 8 for free passage of the folder or folders, which after insertion in the opening 4 are pressed together between the support means 5, 6 by the displaceable support means being moved with the aid of the handle 8 in a direction towards the fixed support means 5.

Before the folder 30, or folders, is inserted in the opening 4, the operator has selected the time which suitably should be sufficient for the actual binding operation, this time being dependent on the type of folder and the number of folders. Time selection is performed by depressing one of the buttons in the push button unit 10, and these buttons can be marked with specific times or with more general designations such as "slow", "normal", "rapid" and "very rapid".

When the folder 30, or folders, is inserted in the opening 4 the light beam to the photocell 16 is interrupted and the time control circuit (the timer) starts. If the folders were to be taken out so that the light beam once again is allowed to strike the photocell 16, the time control circuit function ceases and will be immediately zeroed. After the folders have been left in the opening 4, the time control circuit is in operation for the set time, simultaneously as the spine portion 33 of the folder and the binding layer 36 there are heated by the hotplate 2, which keeps a constant temperature of about 200° C. with the aid of a thermostat. When the set time has come to an end, the time control circuit activates the alarm device which includes the signal lamp 12 and a buzzer, for example. The folders are then lifted out of the binding apparatus and allowed to cool, whereafter the sheets inserted in the folders are firmly adhered to the spine portion of the folders. In conjunction with the folder or folders being lifted out of the binding apparatus, the time control circuit is zeroed. However, current supply to the hotplate 2 is still maintained, and the apparatus is thus ready for immediate use.

Even if the binding apparatus above has been described in detail in conjunction with the preferred embodiment, this must not be regarded as restricting the invention. For example, the push button unit 10 can be formed with more or less buttons, or formed as a rotary or sliding control means. The main switch 11 and the signal lamp 12 can be incorporated in an illuminating switch button. The handle 8 can be formed in some other way and/or given another location. The light source 15 and photocell 16 can be located in other positions, the sole requirement being that the light beam is affected by an inserted folder. In this respect it is also conceivable that the light source 15 and photocell 16 are parallel to each other and that the folder forms a mirror to supply the photocell with light when the folder is inserted in the opening 4, thus triggering the time control circuit. The time control circuit is thus zeroed when the folder is taken out of the binding apparatus and the photocell 16 is no longer supplied with light. Other modifications of the binding apparatus are also conceivable within the scope of the invention.

I claim:

1. Apparatus intended for binding sheets in a folder or file provided with a heat-sensitive binding agent and comprising a hotplate on which the folder with inserted sheets is placed for heating the binding agent, said hotplate having at least one electrical heating element and being supported within a housing having a cover provided with an opening for inserting the folder, the heating element being supplied with electrical current via a current regulating circuit, automatic time control means, power means for continuously supplying current to the heating element to cause said heating element to be heated to working temperature independent of said time control means for binding several folders successively while maintaining said current supply to said heating element, said time control means being electrically connected to light sensor means for sensing the insertion of a folder including a photocell located in the path of a light beam projecting across said cover opening from a light source supported by such housing such that said light beam is changed by the insertion of a folder through said opening thereby causing the photocell to transmit a signal to the time control means for automatically starting its set timing cycle, at the termination of which said time control means automatically activates an alarm means, and means for adjusting the time control means to select between different preset time cycles.

2. Apparatus as claimed in claim 1, characterized in that the heating element comprises a heating foil fastened between two surfaces of heat conductive material, the upper surface constituting the support surface for the folder inserted through the cover opening.

3. Apparatus as claimed in claim 2, characterized in that the support surface is formed with folded flanges having threaded holes for screws, the ends of which bear against the second material surface under the support surface to bring the heating foil into intimate contact with the underside of the supporting surface.

4. Apparatus as claimed in claim 2 or 3, characterized in that the hotplate is mounted on bushings of heat-resistant plastics, said bushes being attached to the support surface and the bottom of the cover by means of blind screws.

5. Apparatus, intended for binding sheets in a folder or file provided with a heat-sensitive binding agent and comprising a hotplate on which the folder with inserted sheets is placed for heating the binding agent, said hotplate having at least one electrical heating element and being supported within a housing having a cover provided with an opening for inserting the folder, the width of the opening being adjustable with the aid of support means for the folder, the heating element being supplied with electrical current via a current regulating circuit, automatic time control means, power means for continuously supplying current to the heating element to cause said heating element to be heated to working temperature independent of said time control means, said time control means being electrically connected to a photocell located in the path of a light beam projecting across said cover opening from a light source supported by such housing such that said light beam is changed by the insertion of a folder through said opening thereby causing the photocell to transmit a signal to the time control means for automatically starting its set timing cycle, at the termination of which said time control means automatically activates an alarm means, said light beam being emitted from a light source supported at the bottom of the cover and at the opposing end of the opening, such that the light beam is reflected onto the photocell by a reflector arranged on an angularly disposed portion of a fixed rear support means for the folder, the folder with sheets being kept pressed against said support means with the aid of a forward displaceable support means.

6. Apparatus, intended for binding sheets in a folder or file provided with a heat-sensitive binding agent and comprising a hotplate on which the folder with inserted sheets is placed for heating the binding agent, said hotplate having at least one electrical heating element and being supported within a housing having a cover provided with an opening for inserting the folder, the width of the opening being determined by the aid of support means for the folder, the heating element being supplied with electrical current via a current regulating circuit, automatic time control means, power means for continuously supplying current to the heating element to cause said heating element to be heated to working temperature independent of said time control means, said time control means being electrically connected to a photocell located in the path of a light beam projecting across said cover opening from a light source supported by such housing such that said light beam is changed by the insertion of a folder through said opening thereby causing the photocell to transmit a signal to the time control means for automatically starting its set timing cycle, at the termination of which said time control means automatically activates an alarm means, said time control means comprises an electrical semiconductor circuit including time controlling resistor and/or capacitor elements providing at least one preset time, the respective elements being put in said circuit by time selecting means.

7. Apparatus as claimed in claim 6, characterized in that the number of selectable time periods is four and that the time selecting means form a push button unit which is formed with a connector for receiving a printed circuit board carrying the components of the regulating circuit.

8. Apparatus, intended for binding sheets in a folder or file provided with a heat-sensitive binding agent and comprising a hotplate on which the folder with inserted sheets is placed for heating the binding agent, said hotplate having at least one electrical heating element and being supported within a housing having a cover provided with an opening for inserting the folder, the width of the opening being adjustable with the aid of support means for the folder, the heating element being supplied with electrical current via a current regulating circuit, automatic time control means, power means for continuously supplying current to the heating element to cause said heating element to be heated to working temperature independent of said time control means, said time control means being electrically connected to a photocell located in the path of a light beam projecting across said cover opening from a light source supported by such housing such that said light beam is changed by the insertion of a folder through said opening thereby causing the photocell to transmit a signal to the time control means for automatically starting a set timing cycle, at the termination of which said time control means automatically activates an alarm means, said cover having a table surface, in the rear portion of which said opening is arranged, the adjustability of the opening being determined by the displaceable support means, which has a portion adapted for moving under the table surface and carries a handle, the side pieces of the handle being movable in slots made in the table surface, and the front portion of the table surface supporting a main switch for connecting the electric supply to the heating element, turning on the light source and turning on a signal lamp forming the alarm means.

9. Apparatus as claimed in claim 8, characterized in that the displaceable support means has flanges provided with gliding bearings and which are mounted in rails attached to the bottom of the cover.

* * * * *

UNITED STATES PATENT AND TRADEMARK OFFICE

CERTIFICATE OF CORRECTION

PATENT NO. : 4,367,116

DATED : January 4, 1983

INVENTOR(S) : Sture H. Wilholm

It is certified that error appears in the above—identified patent and that said Letters Patent is hereby corrected as shown below:

Claim 4, line 3, "bushes" should be --bushings--.

Signed and Sealed this

*Twelfth* Day of *April 1983*

[SEAL]

*Attest:*

GERALD J. MOSSINGHOFF

*Attesting Officer*

*Commissioner of Patents and Trademarks*